United States Patent [19]

Vanassche et al.

[11] 3,963,493

[45] June 15, 1976

[54] DIRECT-POSITIVE SILVER HALIDE EMULSION FOGGED TO LOW LEVEL AND THE USE THEREOF IN ENERGETIC-SURFACE DEVELOPMENT

[75] Inventors: Willy Joseph Vanassche, Aartselaar; Herman Alberik Pattyn, Kapellen; Hendrik Alfons Borginon, Mortsel, all of Belgium

[73] Assignee: AGFA-GEVAERT N.V., Mortsel, Belgium

[22] Filed: Dec. 27, 1972

[21] Appl. No.: 318,989

[30] Foreign Application Priority Data

Feb. 18, 1972 United Kingdom ..... 7742/72

[52] U.S. Cl. ..... 96/64; 96/107; 96/108; 96/101; 96/120

[51] Int. Cl.[2] ..... G03C 5/24; G03C 1/28

[58] Field of Search ..... 96/107, 108, 101, 120, 96/64

[56] References Cited

UNITED STATES PATENTS

| | | | |
|---|---|---|---|
| 3,367,778 | 2/1968 | Berriman | 96/101 |
| 3,501,307 | 3/1970 | Illingsworth | 96/107 |
| 3,687,676 | 8/1972 | Spence et al. | 96/108 |
| 3,690,891 | 9/1972 | Spence et al. | 96/101 |
| 3,730,723 | 5/1973 | Gilman et al. | 96/107 |
| 3,767,651 | 10/1973 | Chapman | 96/101 |

*Primary Examiner*—Won H. Louie, Jr.
*Attorney, Agent, or Firm*—A. W. Breiner

[57] ABSTRACT

Direct-positive silver halide emulsions are described which have been fogged so that a test portion thereof when coated at a coverage of 0.50 to 5.50 g of silver per sq.m. gives a density below 0.50 upon processing without exposure for 6 min. at 20°C in a developer I and an identical coated test portion gives a density that is at least twice that of the first test portion with a minimum of 0.50 upon processing without exposure for 3 min. at 20°C in a developer II.

The emulsions have high photographic speed and though fogged to a very low degree can yield direct-positive images of satisfactory density.

34 Claims, No Drawings

DIRECT-POSITIVE SILVER HALIDE EMULSION FOGGED TO LOW LEVEL AND THE USE THEREOF IN ENERGETIC-SURFACE DEVELOPMENT

The present invention relates to direct-positive photographic emulsions and elements which exhibit improved photographic speed.

It is known that direct-positive images can be obtained with certain types of photographic silver halide emulsions without previously forming a negative silver image. For this purpose, the silver halide grains are fogged, before or after coating on a support, by an overall exposure to actinic radiation or by overall chemically fogging e.g. by means of reducing agents. Upon image-wise exposure of the prefogged emulsions the development centers formed by said fogging are destroyed at the exposed areas and remain at the unexposed areas. By subsequent conventional development by means of silver halide developers a direct-positive image is formed.

Particularly suitable direct-positive silver halide emulsions are those comprising electron-traps e.g. compounds acting as electron-acceptors or desensitizers, such as desensitizing dyes which are absorbed to the surface of the fogged silver halide grains. Other favourable direct-positive emulsions are those comprising silver halide grains composed of a central core having centers promoting the deposition of photolytic silver and an outer shell of silver halide, the said centers forming the electron-traps.

According to U.S. Pat. No. 3,501,307 of Bernard D. Illingsworth issued Mar. 17, 1970 direct-positive photographic emulsions with high photographic speed can be obtained when the direct-positive emulsions, particularly direct-positive emulsions comprising a compound that accepts electrons, comprise fogged silver halide grains that show a rapid loss of fog upon bleaching in a chemical bleach. Therefore, the fogged silver halide grains should be such that a test portion of the said emulsion when coated on a support to give a maximum density of at least about one upon processing for six minutes at about 20°C in a developer of the following composition:

| | | |
|---|---|---|
| water (52°C) | 500 | ml |
| N-methyl-p-aminophenol sulphate | 2.5 | g |
| anhydrous sodium sulphite | 30 | g |
| hydroquinone | 2.5 | g |
| sodium metaborate | 10 | g |
| potassium bromide | 0.5 | g |
| water to make | 1 | liter |

has a maximum density which is at least about 30% greater than the maximum density of an identical coated test portion which is processed for six minutes at about 20°C in the above developer after being bleached for about 10 minutes at about 20°C in a bleach composition of:

| | | |
|---|---|---|
| potassium cyanide | 50 | mg |
| acetic acid (glacial) | 3.47 | ml |
| sodium acetate | 11.49 | g |
| potassium bromide | 119 | mg |
| water to make | 1 | liter |

According to the U.S. Pat., the rapid loss of fog upon bleaching as defined above is obtainable by combining a low level of reduction fogging with a low level of gold fogging. The concentration of reduction fogging agent is in the range comprised between about 0.0005 and about 0.06 milliequivalent per mole of silver halide, and the concentration of gold fogging agent is in the range comprised between about 0.001 and about 0.01 millimole per mole of silver halide, the ratio of gold fogging agent to reduction fogging agent being in the range of about 1:3 to about 20:1.

However, as is known in the art, the concentration of the fogging agents does not suffice to determine the degree of fogging. The pH, the pAg and the temperature conditions during fogging as well as the duration of the fogging treatment also have a marked influence on the fogging degree.

According to the U.S. Pat. the lower limit of the fogging degree is such that a density of 0.50 is produced when developing the silver halide emulsion without exposure for five minutes at 20°C in the developer of the above composition, when such an emulsion is coated at a coverage of 50 to about 500 mg of silver per square foot of support.

In accordance with the present invention direct-positive silver halide emulsions are provided that exhibit high photographic speeds which exceed that of the emulsions described in the above U.S. Pat.

The present invention is based on the idea of decreasing the level of fogging to a degree such that the silver halide grains can be hardly considered as fogged silver halide grains but nevertheless allow the production of direct-positive images of satisfactory density.

The direct-positive silver halide emulsion of the invention is an emulsion comprising electron-traps e.g. by the presence in the emulsion of an electron-accepting or desensitizing compound and/or by the use of composite silver halide grains comprising, in their interior, centers promoting the deposition of photolytic silver, and silver halide grains which are provided with silver nuclei and/or nuclei of a metal more electropositive than silver characterized in that the said nuclei are present to such an extent that a test portion of the emulsion, when coated on a support at a coverage of 0.50 g to 5.50 g of silver per sq.m., gives a density of less than 0.50 upon processing without exposure for 6 minutes at 20°C in the developer of the composition given hereinbefore (developer I) and an identical test portion thereof, when coated in an identical way, gives a density which is at least twice the density of the first test portion and which has a value of at least about 0.50 upon processing without exposure for 3 minutes at 20°C in the developer of the following composition (developer II):

| | | |
|---|---|---|
| hydroquinone | 15 | g |
| 1-phenyl-3-pyrazolidinone | 1 | g |
| trisodium salt of ethylene diamine tetraacetic acid | 1 | g |
| anhydrous sodium carbonate | 30 | g |
| anhydrous sodium sulphite | 70 | g |
| 40 % aqueous sodium hydroxide | 16 | ml |
| water to make | 1 | liter |
| | (pH : | 11) |

It was surprising to find that direct-positive silver halide emulsions, of which the silver halide grains with respect to developer I can hardly be considered to be fogged silver halide grains, remained suitable for the production of direct-positive silver images of satisfactory density. In addition thereto high photographic speeds are obtained.

The direct-positive silver halide emulsions of the present invention may comprise any of the known silver halides suitable for the formation of direct-positive silver halide emulsions e.g. silver bromide, silver chloride, silver chlorobromide, silver bromoiodide, and silver chlorobromoiodide.

Especially suitable for use according to the present invention are direct-positive silver halide emulsions the silver halide grains of which have an average grainsize of less than about 1 micron preferably less than 0.5 micron. The silver halide grains can be regular and have one of the commonly known shapes e.g. cubic, octahedral or even rhombohedral. They preferably have a substantially uniform diameter e.g. 95% by weight of the silver halide grains have a diameter within about 30% of the mean grain diameter.

The direct-positive silver halide emulsions of the present invention may be of the type that comprise silver halide grains having internal centers promoting the deposition of photolytic silver. Such direct-positive silver halide emulsions have improved sensitivity as shown by E. Moisar and S. Wagner in "Berichte der Bunsengesellschaft fur physikalische Chemie" 67 (1963) 356–359. Photographic emulsions comprising in the interior of the silver halide grains, centers promoting the deposition of photolytic silver can be prepared e.g. as described in U.K. Pat. Specification 1,027,146 filed Aug. 30, 1963 by Agfa A. G. For this purpose, a homodisperse fine-grain silver halide emulsion with narrow grain-size distribution is made first, preferably by the double jet silver halide precipitating technique. These fine silver halide grains will serve as core for the ultimate emulsion.

The silver halide cores thus formed are then treated so as to produce centers which promote the deposition of photolytic silver (electron-traps) on the cores. For this purpose, the cores may be treated chemically or physically according to any of the known procedures for producing ripening nuclei i.e. latent image nucleating centers. Such procedures are described e.g. by A. Hautot and H. Sauvenier in "Science et Industries Photographiques", Vol. XXVIII, Jan. 1957, p. 1–23 and p. 57–65.

The ripening nuclei can be formed by chemical sensitization by means of noble metal compounds, especially gold or iridium compounds, by means of sulphur compounds e.g. thiosulphates or by means of both noble metal compounds and sulphur compounds. Ripening of the silver halide cores can also be effected by means of reducing agents e.g. hydrazine, thiourea dioxide or tin(II)chloride, if desired together with noble metal compounds.

Electron-traps can further be provided by treating the silver halide cores with aqueous solutions of salts of polyvalent metals e.g. of the trivalent bismuth.

It is also possible to use the compounds suitable for the formation of the electron traps e.g. the chemical sensitizers referred to hereinbefore, during the precipitation of the fine-grain silver halide i.e. during the formation of the core for the ultimate silver halide emulsion. In this way, the electron traps are statistically distributed in the interior of the core contrary to when adding the compounds after the formation of the fine-grain silver halide where the electron traps are formed substantially at the surface of the core.

After the formation of the core having centers promoting the deposition of photolytic silver, silver halide precipitation is continued to form around the cores an outer shell of silver halide.

The direct-positive silver halide emulsions of the present invention may also be of the type that comprise common silver halide grains and exterior electron traps by the presence of one or more electron accepting or desensitizing compounds.

According to Sheppart et al, J. Phys. Chem. 50 (1946) 210, Stanienda, Z. Phys. Chem. (N.F.) 32 (1962) 238, and Dahne, Z. Wiss. Phot. (1969) 161, desensitizers are dyestuffs of which the cathodic polarographic half-wave potential measured against the calomel electrode, is more positive than −1.0 V. Such like compounds have also been described in U.S. Pat. Nos. 3,501,305, 3,501,306 and 3,501,307 all of Bernard D. Illingsworth issued Mar. 17, 1970. The sensitizers described in German Pat. No. 1,153,246 filed Apr. 11, 1962 by Agfa A.G. and U.S. Pat. No. 3,314,796 of Johannes Gotze, August Randolph and Oskar Riester issued Apr. 18, 1967 are also suitable for this purpose as well as imidazoquinoxalin dyestuffs e.g. those described in Belgian Pat. No. 660,253 filed Feb. 25, 1965 by Kodak Co.

It is known to characterize these electron-accepting or desensitizing compounds by means of their polarographic half-wave potentials. Electron acceptors suitable for use in the direct-positive silver halide emulsions of the present invention have an anodic polarographic half-wave potential and a cathodic polarographic half-wave potential which when added together give a positive sum. Methods of determining these polarographic half-wave potentials have been described e.g. in U.S. Pat. Nos. 3,501,310 of Bernard D. Illingsworth issued Mar. 17, 1970 and 3,531,290 of Roberta A. Litzerman issued Sept. 29, 1970.

The electron-accepting compounds preferably have spectrally sensitizing properties although it is possible to use electron-accepting compounds that do not spectrally sensitize the emulsion.

Inorganic electron-accepting compounds may also be used in the present invention e.g. mercury(II)compounds such as mercury(II)oxide, mercury(II)chloride, mercury(II)cyanide, etc.

As noted above, the silver halide grains of the direct-positive silver halide emulsions of the present invention are provided with silver nuclei and/or nuclei of a metal more electropositive than silver e.g. gold, rhodium, platinum, palladium, irridium etc. to such an extent that a test portion of the emulsion, when coated on a support at a coverage of 0.50 to 5.50 g of silver per sq.m., gives a density of less than 0.50 upon processing without exposure for 6 minutes at 20°C in the above developer I and an identical test portion thereof, when coated in an identical way, gives a density of at least 0.50 and at least twice the density of the first test portion upon processing without exposure for 3 minutes at 20°C in the above developer II.

It is stated that the silver halide grains are provided with silver nuclei and/or nuclei of a metal more electropositive than silver rather than stating that the silver halide grains are "fogged" because the fogging treatment is to such low extent that with respect to common developers such as developer I the treatment can hardly be regarded as a "fogging" treatment. However, when the term "fogging" is used herein it should be interpreted in the light of requirements set forth above.

The silver halide grains can be provided with silver nuclei for example by an overall exposure to actinic radiation and preferably by reduction sensitization e.g. by high pH and/or low pAg silver halide precipitating or digestion conditions e.g. as described by Wood, J. Phot. Sci. 1 (1963) 163, or by treatment with reducing agents.

Reducing agents suitable for use include hydrazine, hydroxylamine, tin(II) compounds e.g. tin(II)chloride, tin complexes and tin chelates of the (poly)amino(-poly)carboxylic acid type as described in British Pat. No. 1,209,050 filed Dec. 27, 1967 by Agfa-Gevaert N.V., ascorbic acid, formaldehyde, thiourea dioxide, polyamines such as diethylene triamine, phosphonium salts such as tetra(hydroxymethyl) phosphonium chloride, bis(p-aminoethyl)sulphide and its water-soluble salts, etc. Preferred reducing agents are thiourea dioxide and tin(II)chloride.

The silver halide grains may alternatively or in addition (preferably the latter) be provided with nuclei of a noble metal i.e. a metal more electropositive than silver for example by addition of a noble metal compound to the silver halide grains, which may already have been provided with silver nuclei, preferably by treatment with a reducing agent. The noble metal compounds include gold compounds e.g. gold(III)chloride, potassium chloroaurate, potassium chloroaurite, and potassium aurithiocyanate, as well as compounds of rhodium, platinum, iridium and palladium e.g. ammonium hexachloropalladate and potassium chloroiridate. Preferred noble metal compounds are gold compounds.

In accordance with the present invention "fogging" of the silver halide grains preferably occurs by means of reducing agent e.g. thiourea dioxide and a compound of a metal more electropositive than silver especially a gold compound. The reducing agent is preferably used initially and the gold compound subsequently. However, the reverse order can be used or both compounds can be used simultaneously.

When the silver halide grains have in their interior centers promoting the deposition of photolytic silver the so-called "fogging" of the silver halide relates to the silver halide of the outer shell and is then a surface "fogging" which has nothing to do with the chemical sensitization of the central silver halide core.

The direct-positive silver halide emulsions according to the present invention are capable of forming direct-positive images upon development of the exposed emulsions, when the said development is an energetic development e.g. by means of a developer II of the composition given hereinbefore. The high energy may be obtained by properly alkalizing the developing composition (pH 9–12), by using relatively high concentrations of the ingredients in the developer, by using high energy developing agents or a combination of developing agents, which as a consequence of their superadditive action is very energetic for example hydroquinone together with 1-phenyl-3-ppyrazolidinone or together with N-methyl-p-aminophenol sulphate, by addition to the developer and/or the photographic element of development accelerators e.g. polyethylene glycol and other polyoxyalkylene compounds as well as quaternary ammonium or phosphonium compounds and ternary sulphonium compounds. For example, favourable results are obtained by means of developing compositions comprising per liter at least 5 g of hydroquinone and an auxiliary developing agent of the pyrazolidinone type especially 1-phenyl-3-pyrazolidinone, the optimum concentration of which, relative to the amount of hydroquinone, can be determined by routine laboratory experiments. Favourable results can also be obtained with compositions comprising as developing agents ascorbic acid and 1-phenyl-3-pyrazolidinone.

It may be advantageous to use developing compositions substantially free of bromide e.g. potassium bromide as described in the copening Application No. 7743/72 in the name of Agfa-Gevaert N.V. filed Feb. 18, 1972 on even date herewith for "Development of direct-positive silver halide elements".

One or more developing agents can be incorporated in the direct-positive photographic element. They can be incorporated in the silver halide emulsion itself and/or in another suitable location in the photographic element. Development can then be effected by means of an alkaline processing solution called development activator solution, which is substantially free of developing agents.

The developer or activator solution can be supplied in an amount which suffices for the treatment of exactly one piece of light-sensitive element. In this case the liquid is called a single-use bath. A bath of this type offers the advantage that ageing and contamination of the bath compositions are eliminated.

For one-time use the developer is preferably relatively viscous by addition to the developer of a thickening agent, preferably a water-soluble film-forming material e.g. a water-soluble plastic. The film-forming plastic may be any of the high molecular weight polymers which are stable to alkali and which are soluble in aqueous alkaline solutions e.g. hydroxyethylcellulose, starch or gum, polyvinyl alcohol, the sodium salts of polymethacrylic acid and polyacrylic acid, sodium alginate, sodium carboxymethyl cellulose, etc. The relatively viscous developer composition may be confined within a container which is ruptured at the moment of development as is done for instance in the well-known silver complex diffusion transfer process for in-camera processing.

In the formation of direct-positive silver halide emulsions according to the present invention various colloids can be used as vehicles or binding agents for the silver halide. They include any of the hydrophilic colloids generally employed in the photographic field for example gelatin, colloidal albumin, casein, cellulose derivatives e.g. carboxymethyl cellulose, alginic acid and derivatives thereof such as esters, amides and salts thereof, synthetic resins e.g. polyvinyl compounds such as polyvinyl alcohol and poly-N-vinylpyrrolidone.

In addition to the hydrophilic binding agents other synthetic binding agents can be employed in the emulsion e.g. homo- and copolymers of acrylic or methacrylic acid or derivatives thereof such as esters, amides and nitriles and vinyl polymers for example vinyl esters and vinyl ethers.

The direct-positive photographic silver halide emulsions can be coated on one or both sides of a wide variety of supports which include opaque supports e.g. paper and metal supports as well as transparent supports e.g. glass, cellulose nitrate film, cellulose acetate film, cellulose aceto-butyrate film, polyvinyl acetal film, polystyrene film, polyethylene terephthalate film and other polyester film. It is also possible to employ paper coated with $\alpha$-olefin polymers e.g. paper coated with polyethylene, polypropylene, ethylene-butylene copolymers and the like.

The silver halide emulsion layer and any other hydrophilic colloid layers which may be present in a direct-positive photographic material of the invention may be hardened with any suitable hardener used in silver halide materials e.g. formaldehyde, dialdehyde, hydroxyaldehyde, mucochloric and muco-bromic acid, acrolein, glyoxal, sulphonyl halides, vinyl sulphones, etc. These layers may further comprise plasticizers, surface active agents of the non-ionic, ionic or amphoteric type, antistatic agents, matting agents, light-absorbing dyes, optical brightening agents, and the like.

The silver halide amulsion may further contain any of the ingredients generally employed in silver halide emulsions. They may comprise speed increasing agents of the polyalkylene oxide type e.g. polyethylene glycols and derivatives thereof, quaternary ammonium and phosphonium compounds as well as ternary sulphonium compounds, thioether compounds etc. The emulsions can comprise the common emulsion stabilizing agents e.g. mercury compounds which include homopolar or salt-like compounds of mercury and aromatic or heterocyclic compounds such as mercaptotriazoles, simple mercury salts, sulphonium mercury double salts, etc. They may comprise azaindene emulsion stabilizers for example tetra- or penta-azaindenes especially those comprising hydroxyl or amino groups as described by Birr., Z. Wiss. Phot. 47 (1962) 2–58. Other suitable emulsion stabilizers are heterocyclic mercapto compounds e.g. 1-phenyl 5-mercaptotetrazole, quaternary benzthiazolium derivatives, benztriazole and the like.

In addition to the electron accepting compounds which may have spectrally sensitizing properties, the emulsions may contain other spectrally sensitizing dyes including cyanines, merocyanines, complex (trinuclear) cyanines, complex (trinuclear) merocyanines, styryls and hemicyanines. Moreover, the emulsions may contain colour couplers or may be developed in energetic colour developing compositions comprising colour couplers.

It is possible to stabilize the direct-positive photographic element against loss of maximum density upon storing by subjecting the elements to a vacuum treatment. The elements can be subjected to a short vacuum treatment or they can be packed and stored in vacuum e.g. the elements can be sealed within an evacuated plastic envelope. It is also possible, after having applied the vacuum, to store the elements in inert gases e.g. nitrogen.

Photographic materials comprising at least one direct-positive silver halide emulsion according to the present invention can be used in a large variety of photographic fields, e.g. materials of high gradation can be used in the graphic arts, materials of low gradation can be used as direct-positive X-ray material and other materials can be used for the production of direct-positive colour images.

The following examples illustrate the present invention.

EXAMPLE 1

A monodisperse cubic direct-positive photographic silver bromoiodide (2.5 mole % of iodide) emulsion having an average grain size of about 0.1 micron was prepared under controlled pH, pAg and temperature conditions, during precipitation of the silver halide. The pH was maintained at 5.5, the pAg at 8.2 and the temperature at 45°C. The pAg was then adjusted to 10 whereupon the emulsion was chill-set, shredded and washed with cold water.

The emulsion was divided into several aliquot portions and each portion was doped with a gold compound (15 mg of hydrogen tetrachloroaurate(III) per mole of silver halide) at pH 7 and at pAg 8.2.

The emulsion portions were heated at 60°C for a period of time as listed in the table below. To each portion were added per mole of silver halide: 600 mg of pinacryptol yellow as electron-acceptor and 600 mg of the spectrally sensitizing dye with formula:

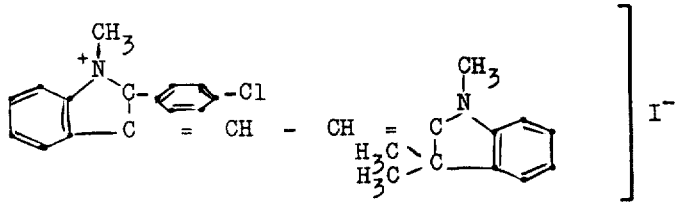

The emulsions were coated on a conventional film support at coverages of 3.75 g of silver and 3.75 g of gelatin per sq.m. The emulsions were dried, and developed without exposure for 6 min, at 20°C in developer I of the composition given hereinbefore and for 3 min. at 20°C in the developer II of the composition given hereinbefore. After development the emulsions were fixed, washed and dried in the usual way.

The results were as follows:

| pAg | hours of "fogging" treatment | maximum density developer I | maximum density developer II |
|---|---|---|---|
| 8.2 | 2 | 0.24 | 1.80 |
| | 3 | 0.33 | 2.40 |
| | 4 | 0.46 | 2.70 |

It can be seen from the above results that it is possible to use direct-positive emulsions, the silver halide grains of which have been fogged to a very low extent, for direct-positive image formation and to reach upon development sufficient maximum density. The results further show that the degree of fogging is markedly dependable on the time of the so-called fogging so that with the same amount of gold compound different degrees of fogging can be reached.

EXAMPLE 2

Example 1 was repeated with the difference that the so-called fogging of the emulsion portion was now carried out at two different pAg values, the pH being 7 and the time of fogging at 60°C being 2 hours.

The results were as follows:

| pAg | maximum density developer I | maximum density developer II |
|---|---|---|
| 8.2 | 0.24 | 1.80 |

-continued

| pAg | maximum density developer I | maximum density developer II |
|---|---|---|
| 5.3 | 0.42 | 2.30 |

The above results show that the degree of fogging is strongly dependent on the pAg during fogging. They further show that favourable maximum densities can be obtained with developer II even though the maximum density in developer II is unsatisfactory.

EXAMPLE 3

A monodisperse cubic direct-positive photographic silver bromoiodide emulsion as described in example 1 was prepared.

The emulsion was divided into two aliquot portions. To emulsion portion A were added 0.40 mg of thiourea dioxide and 15 mg of hydrogen tetrachloroaurate(III) per mole of silver halide at a pH 7, pAg 8.2 and 60°C. Heating at 60°C was continued for 60 min. Emulsion portion B was treated in the same way with the difference that the thiourea dioxide was used in an amount of 0.10 mg per mole of silver halide.

After addition of 600 mg of pinacryptol yellow and 600 mg of the dye of example 1 per mole of silver halide the emulsion portions were coated as described in example 1.

The emulsions were exposed in a sensitometer and developed at 20°C either for 5 min. in developer I or for 3 min. in the developer II whereupon they were fixed, washed and dried.

The maximum density and photographic speed, measured at the mean density between minimum and maximum density, are listed in the following table. The values given for the speed are relative values, the speed of the emulsion portion A developed in developer I has been given a value of 100. The results were as follows:

| Emulsion | developer I | | developer II | |
|---|---|---|---|---|
| | $D_{max}$ | Rel. speed | $D_{max}$ | Rel. speed |
| A | 1.08 | 100 | >3.00 | 87 |
| B | 0.19 | — | 1.14 | 2500 |

From these results it is clearly apparent that even though the degree of fogging in emulsion B is markedly reduced as compared with emulsion A (maximum density obtained in developer I 0.19 instead of 1.08), a favourable density is still obtainable in developer II ($D_{max}$ = 1.14) so that the emulsion is suitable for direct-positive image formation. Moreover as compared with the emulsion A, emulsion B exhibits a markedly increased speed.

EXAMPLE 4

To 1500 ml of a 3.5% aqueous solution of gelatin at 45°C, ammonia was added to obtain pH 9.3. To the solution were then added for 7 min. 30 sec. 3N aqueous solutions of silver nitrate and of potassium bromide at a rate of 20 ml per minute. During the addition the pAg was maintained at a value corresponding to an E.M.F. of +20 mV (Ag/saturated reference calomel electrode). The silver bromide grains (cores) formed were chemically ripened by addition of 8.8 ml of a 1°/oo solution of thiourea dioxide and digesting the emulsion for 30 minutes at 45°C. The pH was lowered to 6.3 by means of dilute sulphuric acid whereupon 8 ml of a combined aqueous solution of 0.06% by weight of gold(III)chloride and 0.12% by weight of ammonium thiocyanate were added. Digestion was continued for 10 minutes at 45°C.

Precipitation of the silver halide was then continued. For this purpose an aqueous solution of ammonia was added to adjust the pH to 9.3, whereupon the 3N aqueous solutions of silver nitrate and potassium bromide were added at a rate of 38 ml per minute for 35 minutes. During the addition the pAg was maintained at a value corresponding to an E.M.F. of +20 mV. In this way the ripened silver bromide cores were covered with a shell of unripened silver bromide.

After addition of 465 g of gelatin, the emulsion was solidified and washed in the usual way.

The emulsion obtained was divided into several aliquot portions and each portion was treated with an amount of thiourea dioxide as listed in the table below at 60°C, pH 6.5 and pAg 8.2 for 1 h 30 min. The emulsion portions were then coated on a conventional film support, dried, exposed in a sensitometer and developer either for 6 min. at 20°C in developer I or for 3 min. at 20°C in developer II, the composition of which has been given above. The emulsions were then fixed, washed and dried in the usual way.

The results were as follows.

| mg thiourea dioxide per mole of silver bromide in the composite silver halide grains | developer I | developer II | |
|---|---|---|---|
| | $D_{max}$ | $D_{max}$ | Rel. speed |
| 0.90 | 0.30 | 1.70 | 100 |
| 1.20 | 0.70 | 1.80 | 60 |
| 1.50 | 0.85 | 2.20 | 39 |

The above results show that when the degree of fogging is higher than in accordance with the present invention, the photographic speed is markedly reduced. When the degree of fogging is in accordance with the present invention, it is still possible to obtain favourable values of maximum density.

EXAMPLE 5

Emulsion portions were prepared as described in example 1 (fogging at pAg 8.2 - time : 2 hours). One of the emulsion portions was then exposed and developed for 3 min. at 20°C in developer II, the composition of which has been given above. Other emulsion portions were exposed and then developed for 3 min. at 20°C in viscous developers A and B obtained by mixing the composition of developer II with carboxymethyl cellulose to reach a viscosity at 20°C of 70 cP and 750 cP respectively.

The results were as follows:

| Developer | $D_{max}$ | $D_{min}$ |
|---|---|---|
| test | 1.80 | 0.16 |
| A | 2.04 | 0.12 |
| B | 2.00 | 0.12 |

The above results show that the use of a viscous developer has a favourable effect on the maximum and minimum density.

EXAMPLE 6

A monodisperse silver bromide emulsion having an average grain size of about 0.2 micron was prepared under controlled pH, pAg and temperature conditions during precipitation of the silver halide. The pH was maintained at 3, the pAg at 8.5 and the temperature at 50°C. The pAg of the emulsion was then adjusted to 10 whereupon the emulsion was chill-set, shredded and washed with cold water.

The emulsion was doped with 7.14 mg of hydrogen tetrachloroaurate(III) per mole of silver halide and the pH adjusted to 7 and the pAg to 8.18 whereupon the emulsion was digested for 3 hours 45 minutes at 55°C.

After the addition of the electron-acceptor and spectrally sensitizing dye of example 1, each in an amount of 72 mg per kg of emulsion, the emulsion was coated on a conventional film support so that an amount of silver halide equivalent to 5 g of silver nitrate was present per sq.m.

After drying the film material was cut into several strips and each strip was developed at 20°C as follows:

6 min. in developer I, 3 min. in developer II, 3 min. in developer III which consists of an aqueous alkaline (pH : 10.8) solution of 15 g of hydroquinone, 10 g of 1-phenyl-3-pyrazolidinone, and 0.5 g of potassium bromide per liter, 3 min. in developer IV which consists of an aqueous alkaline (pH 10.8) solution of 15 g of hydroquinone, 10 g of N-methyl-p-aminophenol sulphate, and 0.5 g of potassium bromide per liter;

3 min. in developer V which consists of an aqueous alkaline (pH 10.8) solution of 15 g of hydroquinone and 10 g of N-methyl-p-aminophenol sulphate per liter.

The developed densities are listed in the following table:

| developer | density |
|---|---|
| I | 0.15 |
| II | 2.15 |
| III | 2.00 |
| IV | 0.80 |
| V | 0.95 |

The above results show that whereas the degree of fogging according to the present invention is insufficient to obtain satisfactory densities with developer I, the fogging suffices to provide suitable densities with developers II to V.

EXAMPLE 7

Example 6 was repeated with the difference that the strips were developed at 20°C as follows:

6 min. in developer I 3 min. in developer II 3 min. in developer VI which consists of an aqueous alkaline (pH: 11) solution of 0.5 g of potassium bromide, 20 g of ascorbic and 5 g of 1-phenyl-3-pyrazolidinone per liter, 3 min. in developer VII which consists of an aqueous alkaline (pH : 11) solution of 0.5 g of potassium bromide, 15 g of ascorbic acid and 15 g of 1-phenyl-3-pyrazolidinone per liter.

The developed densities are listed in the following table

| developer | density |
|---|---|
| I | 0.10 |
| II | 1.70 |
| VI | 1.65 |
| VII | 2.20 |

We claim:

1. A direct-positive silver halide emulsion for the production of direct-positive images having a satisfactory density comprising fogged silver halide grains containing electron-traps selected from the group consisting of a. silver halide grains having adsorbed to the surface thereof one or more electron-accepting compounds having an anodic polarographic half-wave potential and a cathodic polarographic half-wave potential which when added together give a positive sum; and b. silver halide grains having, in their interior, centers promoting the deposition of photolytic silver, wherein the silver halide grains have been fogged to such an extent that a test portion of the silver halide emulsion when coated on a support at a coverage of 0.50 to 5.50 g of silver per sq.m., gives a density of less than 0.50 upon processing, without exposure, for 6 minutes at 20°C in a developer of the following composition:

| | | |
|---|---|---|
| water (52°C.) | 500 | ml |
| N-methyl-p-aminophenolsulphate | 2.5 | g |
| hydroquinone | 2.5 | g |
| anhydrous sodium sulphite | 30 | g |
| sodium metaborate | 10 | g |
| potassium bromide | 0.5 | g |
| water to make | 1 | liter |

and an identical test portion thereof, when coated in an identical way gives a density of at least twice the value of the density of the first test portion and a density of at least 0.50 upon processing, without exposure, for 3 minutes at 20°C. in a developer of the following composition:

| | | |
|---|---|---|
| hydroquinone | 15 | g |
| 1-phenyl-3-pyrazolidinone | 1 | g |
| trisodium salt of ethylene diamine tetraacetic acid | 1 | g |
| anhydrous sodium carbonate | 30 | g |
| anhydrous sodium sulphite | 70 | g |
| 40% aqueous sodium hydroxide | 16 | ml |
| water to make | 1 | liter |
| | (pH : | 11). |

2. A direct-positive silver halide emulsion according to claim 1 wherein the emulsion comprises an electron accepting or desensitizing compound.

3. A direct-positive silver halide emulsion according to claim 1 wherein the silver halide grains are of the type having, in their interior, centers promoting the deposition of photolytic silver.

4. A direct-positive silver halide emulsion according to claim 1, wherein the silver halide grains are fogged by reduction sensitization of the silver halide grains.

5. A direct-positive silver halide emulsion according to claim 4, wherein the silver halide grains are fogged by treatment of the silver halide grains with thiourea dioxide or tin(II) chloride.

6. A direct-positive silver halide emulsion according to claim 1, wherein the silver halide grains are fogged by sensitization with a compound of a metal more electropositive than silver.

7. A direct-positive silver halide emulsion according to claim 6, wherein the said compound of a metal more electropositive than silver is a gold compound.

8. A direct-positive silver halide emulsion according to claim 1, wherein the silver halide grains are fogged by both reduction sensitization and sensitization with a compound of a metal more electropositive than silver.

9. A direct-positive silver halide emulsion according to claim 8, wherein the said compound of a metal more electro-positive than silver is a gold compound.

10. A direct-positive silver halide emulsion according to claim 1 wherein the silver halide grains have an average grain size of less than 1 micron.

11. A direct-positive silver halide emulsion according to claim 1 wherein 95% by weight of the silver halide grains have a diameter within about 30% of the mean grain diameter.

12. A direct-positive silver halide emulsion according to claim 1 wherein the emulsion contains a spectrally sensitizing dye.

13. A photographic element comprising a support and at least one direct-positive silver halide emulsion layer, which layer will produce a direct-positive image having a satisfactory density and comprises fogged silver halide grains containing electron-traps selected from the group consisting of a. silver halide grains having adsorbed to the surface thereof one or more electron-accepting compounds having an anodic polarographic half-wave potential and a cathodic polarographic half-wave potential which when added together give a positive sum; and b. silver halide grains having, in their interior, centers promoting the deposition of photolytic silver, wherein the silver halide grains have been fogged to such an extent that a test portion thereof when coated as a photographic silver halide emulsion on a support at a coverage of 0.50 to 5.50 g of silver per sq.m., gives a density of less than 0.50 upon processing, without exposure, for 6 minutes at 20°C. in a developer (I) of the following composition:

| | | |
|---|---|---|
| water (52°C.) | 500 | ml |
| N-methyl-p-aminophenolsulphate | 2.5 | g |
| hydroquinone | 2.5 | g |
| anhydrous sodium sulphite | 30 | g |
| sodium metaborate | 10 | g |
| potassium bromide | 0.5 | g |
| water to make | 1 | liter |

and an identical test portion thereof, when coated in an identical way gives a density of at least twice the value of the density of the first test portion and a density of at least 0.50 upon processing, without exposure, for 3 minutes at 20°C. in a developer (II) of the following composition:

| | | |
|---|---|---|
| hydroquinone | 15 | g |
| 1-phenyl-3-pyrazolidinone | 1 | g |
| trisodium salt of ethylene diamine tetraacetic acid | 1 | g |
| anhydrous sodium carbonate | 30 | g |
| anhydrous sodium sulphite | 70 | g |
| 40% aqueous sodium hydroxide | 16 | ml |
| water to make | 1 | liter |
| | (pH : | 11). |

14. A photographic element according to claim 13 wherein the emulsion comprises an electron accepting or desensitizing compound.

15. A photographic element according to claim 13 wherein the silver halide grains are of the type having, in their interior, centers promoting the deposition of photolytic silver.

16. A photographic element according to claim 13, wherein the silver halide grains are fogged by reduction sensitization of the silver halide grains.

17. A photographic element according to claim 16, wherein the silver halide grains are fogged by treatment of the silver halide grains with thiourea dioxide or tin-(II) chloride.

18. A photographic element according to claim 13, wherein the silver halide grains are fogged by sensitization with a compound of a metal more electropositive than silver.

19. A photographic element according to claim 18, wherein the said compound of a metal more electropositive than silver is a gold compound.

20. A photographic element according to claim 13, wherein the silver halide grains are fogged by both reduction sensitization and sensitization with a compound of a metal more electropositive than silver.

21. A photographic element according to claim 20, wherein the said compound of a metal more electropositive than silver is a gold compound.

22. A photographic element according to claim 13, wherein the silver halide grains have an average grain size of less than 1 micron.

23. A photographic element according to claim 13, wherein 95% by weight of the silver halide grains have a diameter within about 30% of the mean grain diameter.

24. A photographic element according to claim 13, wherein the emulsion contains a spectrally sensitizing dye.

25. A process of forming direct-positive images having a satisfactory density by imagewise exposure of an emulsion comprising fogged silver halide grains containing electron-traps selected from the group consisting of a. silver halide grains having adsorbed to the surface thereof one or more electron-accepting compounds having an anodic polarographic half-wave potential and a cathodic polarographic half-wave potential which when added together give a positive sum; and b. silver halide grains having, in their interior, centers promoting the deposition of photolytic silver, wherein the silver halide grains have been fogged to such an extent that a test portion of the silver halide emulsion when coated on a support at a coverage of 0.50 to 5.50 g of silver per sq.m., gives a density of less than 0.50 upon processing, without exposure, for 6 minutes at 20°C. in a developer (I) of the following composition:

| | | |
|---|---|---|
| water (52°C.) | 500 | ml |
| N-methyl-p-aminophenolsulphate | 2.5 | g |
| hydroquinone | 2.5 | g |
| anhydrous sodium sulphite | 30 | g |
| sodium metaborate | 10 | g |
| potassium bromide | 0.5 | g |
| water to make | 1 | liter |

and an identical test portion thereof, when coated in an identical way gives a density of at least twice the value of the density of the first test portion and a density of at least 0.50 upon processing, without exposure, for 3 minutes at 20°C. in a developer (II) of the following composition:

| | | |
|---|---|---|
| hydroquinone | 15 | g |
| 1-phenyl-3-pyrazolidinone | 1 | g |
| trisodium salt of ethylene diamine tetraacetic acid | 1 | g |
| anhydrous sodium carbonate | 30 | g |
| anhydrous sodium sulphite | 70 | g |
| 40% aqueous sodium hydroxide | 16 | ml |
| water to make | 1 | liter |
| | (pH : | 11) |

and subsequent development in said developer (II) in the absence of a silver halide fogging agent and without giving a light flash during development.

26. The process of claim 25 wherein the silver halide emulsion includes an electron-accepting or desensitizing compound.

27. The process of claim 25 wherein the silver halide grains are fogged by reduction sensitization of the silver halide grains.

28. The process of claim 27 wherein the silver halide grains are fogged by treatment of the silver halide grains with thiourea dioxide or tin(II) chloride.

29. The process of claim 25 wherein in the silver halide emulsion the silver halide grains are fogged by sensitization with a compound of a metal more electropositive than silver.

30. The process of claim 29 wherein said compound of a metal more electropositive than silver is a gold compound.

31. The process of claim 25 wherein in said silver halide emulsion the silver halide grains are fogged by both reduction sensitization and sensitization with a compound of a metal more electropositive than silver.

32. The process of claim 25 wherein the silver halide grains have an average grain size of less than 1 micron.

33. The process of claim 25 wherein 95 percent by weight of the silver halide grains have a diameter within about 30 percent of the mean grain diameter.

34. The process of claim 25 wherein said silver halide emulsion includes a spectrally sensitizing dye.

* * * * *